US006952942B2

(12) United States Patent
Graefe et al.

(10) Patent No.: US 6,952,942 B2
(45) Date of Patent: Oct. 11, 2005

(54) DISCHARGE DEVICE OF AN EXTRUDING INSTALLATION

(75) Inventors: Joachim Graefe, Schwerte (DE); Uwe Muschalik, Duisburg (DE)

(73) Assignee: SMS Eumuco GmbH, Leverkusen (DE)

( * ) Notice: Subject to any disclaimer, the term of this patent is extended or adjusted under 35 U.S.C. 154(b) by 0 days.

(21) Appl. No.: 10/469,503

(22) PCT Filed: Feb. 21, 2002

(86) PCT No.: PCT/DE01/00629

§ 371 (c)(1),
(2), (4) Date: Sep. 23, 2003

(87) PCT Pub. No.: WO02/070159

PCT Pub. Date: Sep. 12, 2002

(65) Prior Publication Data

US 2004/0213865 A1 Oct. 28, 2004

(30) Foreign Application Priority Data

Mar. 2, 2001 (DE) ..... 101 10 035

(51) Int. Cl.[7] ..... B21C 23/00
(52) U.S. Cl. ..... 72/256; 72/257; 425/325
(58) Field of Search ..... 72/256, 257, 260, 72/263, 276, 285; 264/209.3, 209.4, 210.1, 210.2, 285; 425/325, 380, 466

(56) References Cited

U.S. PATENT DOCUMENTS

| | | | | | |
|---|---|---|---|---|---|
| 2,422,953 | A | * | 6/1947 | Davies et al. | 264/211.12 |
| 5,305,626 | A | | 4/1994 | Tiekink | |
| 5,743,124 | A | * | 4/1998 | Sugiyama et al. | 72/166 |
| 6,190,595 | B1 | * | 2/2001 | Thoms et al. | 264/177.16 |
| 6,634,200 | B2 | * | 10/2003 | Kleiner et al. | 72/260 |

FOREIGN PATENT DOCUMENTS

| | | | | |
|---|---|---|---|---|
| EP | 0 706 843 | | 4/1996 | |
| JP | 59-184609 | * | 10/1984 | B29C/7/00 |
| JP | 2-179313 | * | 7/1990 | B21C/23/14 |
| JP | 6-15372 | * | 1/1994 | B21D/7/06 |
| JP | 09253736 | | 9/1997 | |

* cited by examiner

*Primary Examiner*—Ed Tolan
(74) *Attorney, Agent, or Firm*—Herbert Dubno

(57) ABSTRACT

The invention relates to a discharge device of an extruding installation (1), particularly provided for producing curved extruded products, that comprises, on a table-like support (8), a channel (7) which accommodates the extruded product. Said channel (7) is provided in the form of a flexible component that can be swung outward from the straight extruding direction (4) thereof.

5 Claims, 1 Drawing Sheet

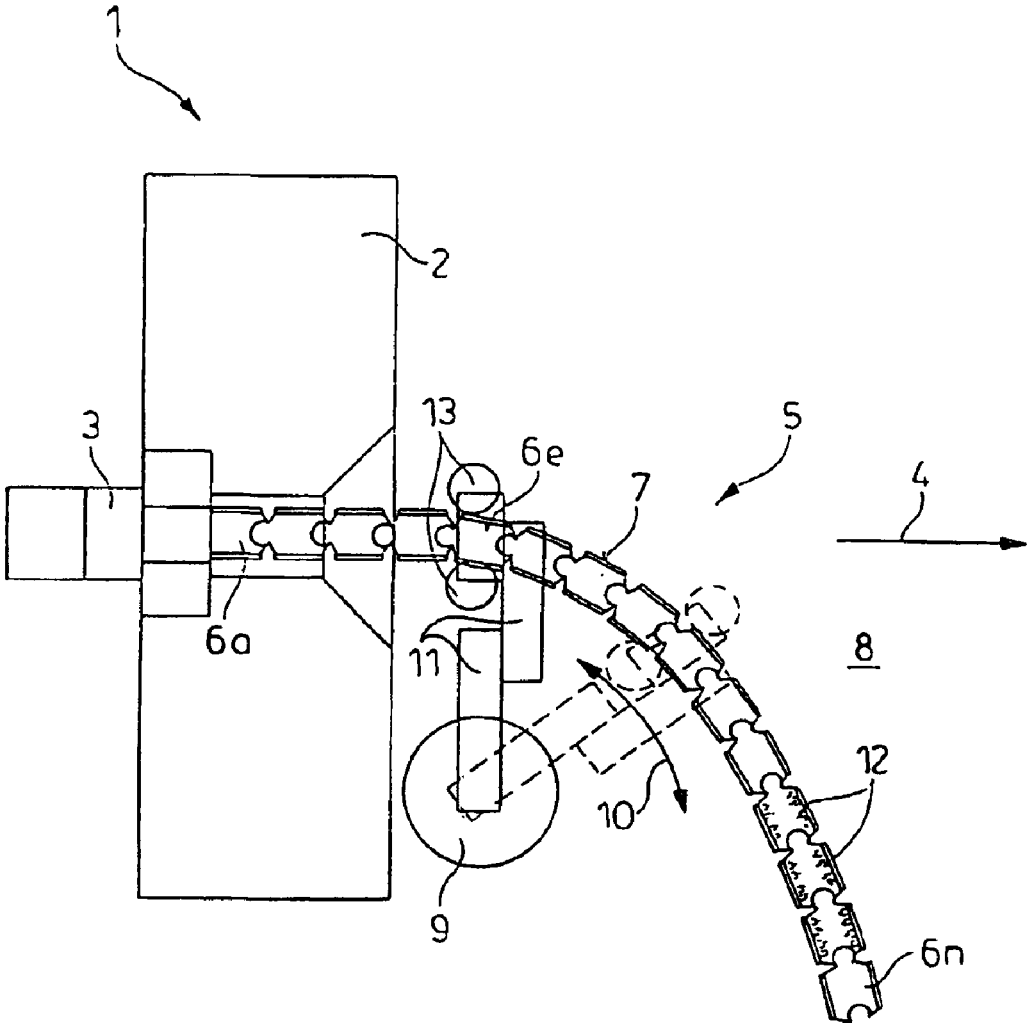
1
2
3
13
6e
5
7
4
6a
11
8
12
10
9
6n

DISCHARGE DEVICE OF AN EXTRUDING INSTALLATION

CROSS REFERENCE TO RELATED APPLICATIONS

This application is a national stage of PCT/DE02/00629 filed 21 Feb. 2002 and is based upon German national application 101 10 035.3 filed 2 Mar. 2001 under the International Convention.

FIELD OF THE INVENTION

The invention relates to a discharge device for an extruder, in particular for producing a curved extrusion, that has a table-like support carrying a channel that receives the extrusion.

BACKGROUND OF THE INVENTION

It is known in a bar or tube extruder or a combined bar/tube extruder to set up the discharge device so it is dependent on the production program. Thus in the extrusion of bars, profiled tubes, and hollow profiles the devices are set up for straight-line extrusion whereas in the production of wire the extruder has a windup spool. In the production of bars with straight-line extrusion there is, downstream of the counter beam, a nondriven roller conveyor. With a spool winder the roller conveyor is moved to the side in order to make room for a wire feed channel. To this end there is connected with the extruder a driven lowerable roller conveyor with cast plates between the driven lowerable rollers. In order to feed the extrusion between the rollers and thus to plastically deform it, the rollers are dropped after the extrusion and as a result the extrusion is set down on the plates or on the support table. From this position the discharge transport is standard.

In order to produce the curved or bent extruded profiles or structural shapes, typically of aluminum, required in various industrial settings for various purposes it is known from EP 0,706,843 in extruders of hollow extrusions with wide variance in wall thicknesses to exert by means of a pusher a force at a predetermined distance from the die outlet or counter beam on the strand such that there is an effect on the profile exiting from the extruder die. The pusher can be a pusher roller, a transversely effective slide surface, or even a roller cage. Regardless what kind of pusher is used, a space must be left for return action immediately or almost immediately after the strand is extruded and bent or curved. In this arrangement the extrusion cross section produced by the extruder die does not move parallel to the die but at an angle thereto.

OBJECT OF THE INVENTION

It is an object of the invention to provide in an extruder of the above-described type in a simple manner a variable drive capable of producing arcuate extrusions.

SUMMARY OF THE INVENTION

This object is attained, according to the invention, in that the channel is flexible and can be pivoted out of a position parallel to the extrusion direction. In order to form curved or bent extrusions, one therefore no longer needs a guide tool spaced at an exact distance from the counter beam or the die, because the flexible channel is shaped according to the extent of lateral displacement of the strand. In this manner there is no problem retrofitting an existing extruding system with a normal discharge device for straight-line extrusion with the device of the invention.

An extruder equipped with the flexible channel according to the invention is, as a result, ideal to use to form extrusions extruded in a straight line from the extruder as well as arcuate extrusions. In addition the flexible and deflectable channel makes it possible to form for example brass wire which can be temporary deflected to allow use of a windup spool.

According to a preferred embodiment of the invention, the channel is formed of individual channel segments like an open-link chain. In this manner the channel, as well as an alternative one made of one piece of flexible bendable material, can assume various radii of curvature including very small ones. To this end a preferred or selected sizing of the members or segments of the channel is provided.

According to an embodiment of the invention the channel is connected to a manipulating robot. This can be a multiaxis robot that can reach the entire length of the channel with a grab arm and thus allow flexible positions to be set because each individual channel segment can be set and made to conform to the preselected bending radius.

When the channel segments are magnetically arrestable, e.g. by means of a supervisory controller and an on/off switchable electromagnet, after turning off the magnetic clamping the path of the channel—straight or bent—can be set according to the desired parameters and locked in by turning the magnets back on. Alternatively, known mechanical latch or lock means can be used for the segments needing to be fixed.

According to a further proposal of the invention at least some of the channel segments are cooled. Switchable water, water-vapor, and/or air nozzles in the segment walls can influence the bendability as well as the crystalline structure of the extrusion.

BRIEF DESCRIPTION OF THE DRAWING

Further features and particularities of the invention are seen in the claims and in the following description of an embodiment of the invention illustrated schematically in a single FIGURE.

The sole FIGURE of the drawing is a diagrammatic side view showing the device of the invention downstream of an extruder die.

SPECIFIC DESCRIPTION

An extruder 1 shown in top view has a counter beam 2 with a tool support 3 and an output 5 directed in an extruding direction shown by arrow 4.

Extending right up to the tool support 3 is a flexible channel 7 formed like a open-link chain of individual channel segments 6*a* to 6*n*. It lies on a table 8 of the output 5 and is pivoted out from the extrusion direction 4 in order to produce a curved or bent extrusion, starting, in the embodiment shown at the channel segment 6*e* at the counter beam 2 and running thereafter to the channel segment 6*n*.

The flexible channel 7 is bent to different radii by a multiaxis manipulating robot 9 that has a manipulating arm 11 that reaches as shown by double-headed arrow 10 along the length or the arc of the channel 7 from the channel segment 6*e* to the last channel segment 6*n*. The channel segments 6*a* to 6*n* having schematically indicated integrated coolers 12 are gripped inside and outside by rollers 13 on the manipulating arm 11 in order to change their positions.

The invention relates to a discharge device for an extruder, in particular for producing a curved extrusion, that has a table-like support carrying a channel that receives the extrusion.

It is known in a bar or tube extruder or a combined bar/tube extruder to set up the discharge device so it is dependent on the production program. Thus in the extrusion of bars, profiles tubes, and hollow profiles the devices are set up for straight-line extrusion whereas in the production of wire the extruder has a windup spool. In the production of bars with straight-line extrusion there is downstream of the counter beam a nondriven roller conveyor. With a spool winder the roller conveyor is moved to the side in order to make room for a wire feed channel. To this end there is connected a driven lowerable roller conveyor with cast plates between the driven lowerable rollers. In order to feed the extrusion between the rollers and thus to plastically deform it, the rollers are dropped after the extrusion and as a result the extrusion is set down on the plates or on the support table. From this position the discharge transport is standard. at least some of the channel segments (6*a* to 6*n*) are cooled.

What is claimed is:

1. A discharge device for an extruder for making an arcuate extrusion, comprising a channel receiving the extrusion, the channel being flexible and deflectable out of a position parallel to a straight extrusion direction into an arcuate position, the channel being formed of individual channel segments articulated to one another in an open-link chain.

2. The discharge device according to claim 1, wherein the channel is connected to a manipulating robot.

3. The discharge device according to claim 2, wherein the channel segments are magnetically arrestable.

4. The discharge device according to claim 2 wherein at least some of the channel segments are cooled.

5. A discharge device for an extruder comprising:

a plurality of channel segments articulated to one another in succession in the form of an open link chain and extending from a discharge part of said extruder and deflectable into a said line with said discharge part and into an arcuate position;

cooling devices provided for at least some of said segments;

a pair of rollers flanking a channel formed by said segments and swingable about an axis to impart an arcuate configuration to said channel; and manipulating a robot carrying said rollers for displacing same.

* * * * *